US008471474B2

(12) United States Patent
Takatsuka et al.

(10) Patent No.: US 8,471,474 B2
(45) Date of Patent: Jun. 25, 2013

(54) VEHICLE DISCHARGE BULB

(75) Inventors: Hiroyuki Takatsuka, Shizuoka (JP); Michio Takagaki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/347,847

(22) Filed: Jan. 11, 2012

(65) Prior Publication Data

US 2012/0181926 A1 Jul. 19, 2012

(30) Foreign Application Priority Data

Jan. 13, 2011 (JP) ..... 2011-005299

(51) Int. Cl.
*H01J 17/16* (2006.01)

(52) U.S. Cl.
USPC ..... 313/634; 313/607

(58) Field of Classification Search
USPC ... 313/25–27, 111–117, 317, 318.01–318.09, 313/483–493, 567–577, 623, 627–643; 439/615, 439/739; 445/22, 24, 26, 29
See application file for complete search history.

(56) References Cited

FOREIGN PATENT DOCUMENTS

| | | | |
|---|---|---|---|
| JP | 6-060851 | A | 3/1994 |
| JP | 2002-304968 | A | 10/2002 |
| JP | 2005-183165 | A | 7/2005 |

*Primary Examiner* — Donald Raleigh
(74) *Attorney, Agent, or Firm* — Sughrue Mion, PLLC

(57) ABSTRACT

A mercury-free vehicle discharge bulb is provided. The discharge bulb includes an arc tube a glass shroud extending in a front-rear direction to cylindrically surround the arc tube, a metal band surrounding and holding a rear end portion of the glass shroud, and an insulating plug supporting the glass shroud in a fixed manner via the metal band. A ratio S1/S2 of a first area S1 to a second area S2 is 1 to 3. The first area S1 is a surface area of an outer surface of the glass shroud in a region from a circumference of the glass shroud at a position of a center of the discharge space to a front end edge of the metal band, and the second area S2 is a surface area of a surface of the metal band that touches the glass shroud.

5 Claims, 3 Drawing Sheets

VEHICLE DISCHARGE BULB

CROSS-REFERENCE TO RELATED APPLICATION

The present application claims priority from Japanese Patent Application No. 2011-005299 filed on Jan. 13, 2011, the entire content of which is incorporated herein by reference.

FIELD OF INVENTION

The present invention relates to a vehicle discharge bulb used as a light source of a vehicle lamp such as a headlamp.

DESCRIPTION OF RELATED ART

Vehicle discharge bulbs generally include an arc tube having a light-emitting tube portion, a cylindrical glass shroud surrounding the arc tube, and an insulating plug securely supporting a rear end portion of the glass shroud via a metal band (see, e.g., JP 2005-183165 A).

The arc tube has pinch-sealed portions between which the light-emitting tube portion is disposed. A pair of electrodes is provided in the pinch-sealed portions such that their distal end portions protrude into a discharge space of the light-emitting tube portion in an opposed manner.

In conventional vehicle discharge bulbs, to increase their luminous efficacy, mercury is sealed in the discharge space of the light-emitting tube portion. However, with an increase of a social need to reduce the use of mercury due to its harmfulness to the environment, mercury-free vehicle discharge bulbs have been proposed. In a mercury-free vehicle discharge bulb, instead of mercury, a metal halide and a rare gas are sealed in the discharge space (see, e.g., JP 2005-183165 A).

In a mercury-free vehicle discharge bulb, to ensure the same level of light flux performance as in vehicle discharge bulbs using mercury, a rare gas is sealed at high pressure.

However, by sealing in a rare gas at high pressure, the gas density in the light-emitting tube portion is increased, and hence, the starting voltage necessary to cause an initial discharge between the two electrodes increases.

To lower the starting voltage, a dielectric barrier discharge can be made to occur easily by sealing a gas, such as a rare gas, in the cylindrical space between the arc tube and the glass shroud (see, e.g., JP 2002-304968 A) or by forming a transparent conductive film on the outer circumferential surface of the light-emitting tube portion of the arc tube (see, e.g., JP 6-060851 A).

To cause a dielectric barrier discharge, it is most effective to set the gas sealing pressure in the cylindrical space at about 0.1 atm. However, where the gas sealing pressure is set so low, slow leakage may occur if the welding of the arc tube and the glass shroud is insufficient, rendering a dielectric barrier discharge less apt to occur. Also when a crack is developed in the welding portion by mechanical impact and the airtightness of the cylindrical space is thereby lowered, a dielectric barrier discharge is made less apt to occur. If a dielectric barrier discharge is made less apt to occur, the start of a discharge may be delayed or the discharge may not even start.

On the other hand, to cause a dielectric barrier discharge by forming a transparent conductive film on the outer circumferential surface of the light-emitting tube portion of the arc tube, the transparent conductive film is required to have a certain thickness. However, this renders the transparent conductive film prone to peel off, that is, it becomes difficult to ensure firm adhesion of the film. Thus, there is a problem in durability.

BRIEF SUMMARY

Illustrative aspects of the present invention provide a mercury-free vehicle discharge bulb having a low starting voltage.

According to an illustrative aspect of the present invention, a metal band is provided to surround and hold a rear end portion of a glass shroud, and by using this metal band, a dielectric barrier discharge is generated to lower the starting voltage.

Specifically, according to an illustrative aspect of the present invention, a mercury-free vehicle discharge bulb is provided. The vehicle discharge bulb includes an arc tube having a light-emitting tube portion, pinch sealed portions between which the light-emitting tube portion is disposed, and a pair of electrodes provided in the pinch-sealed portions such that distal end portions of the pair of electrodes protrude into a discharge space of the light-emitting tube portion in an opposed manner, a glass shroud extending in a front-rear direction to cylindrically surround the arc tube, the glass shroud comprising a front end portion and a rear end portion that are welded to the arc tube, a metal band surrounding and holding the rear end portion of the glass shroud, and an insulating plug supporting the glass shroud in a fixed manner via the metal band. A ratio S1/S2 of a first area S1 to a second area S2 is 1 to 3, wherein the first area S1 is a surface area of an outer surface of the glass shroud in a region from a circumference of the glass shroud at a position of a center of the discharge space to a front end edge of the metal band, and the second area S2 is a surface area of a surface of the metal band that touches the glass shroud.

Magnitudes of the first area S1 and the second area S2 are not limited in particular.

Other aspects and advantages of the invention will be apparent from the following description, the drawings and the claims.

DETAILED DESCRIPTION

Hereinafter, an exemplary embodiment of the present invention will be described in detail with reference to the drawings. However, the following exemplary embodiment does not limit the scope of the claimed invention.

Figure 1:
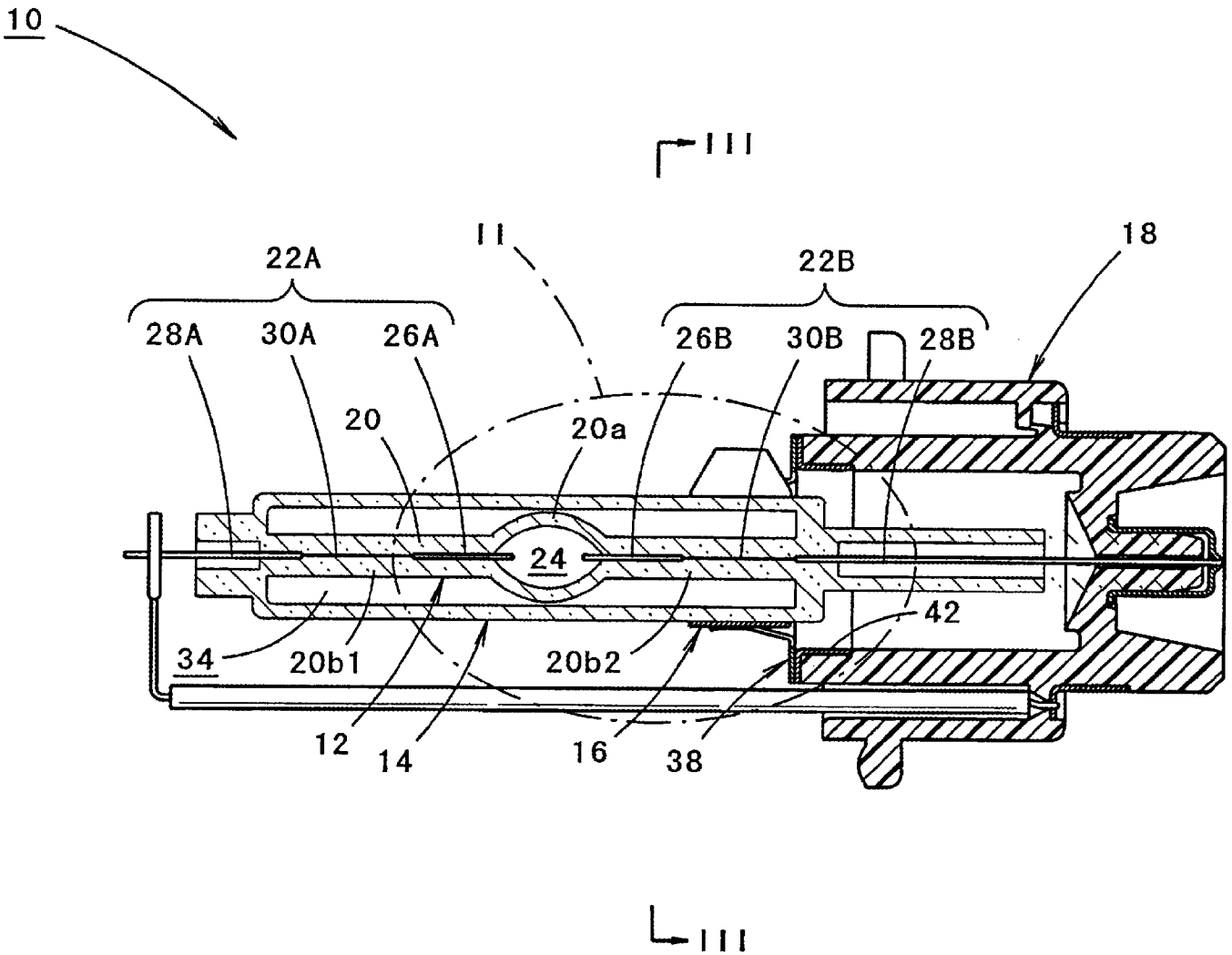
FIG. 1 is a sectional side view of a vehicle discharge bulb according to an exemplary embodiment of the present invention.
Figure 2:
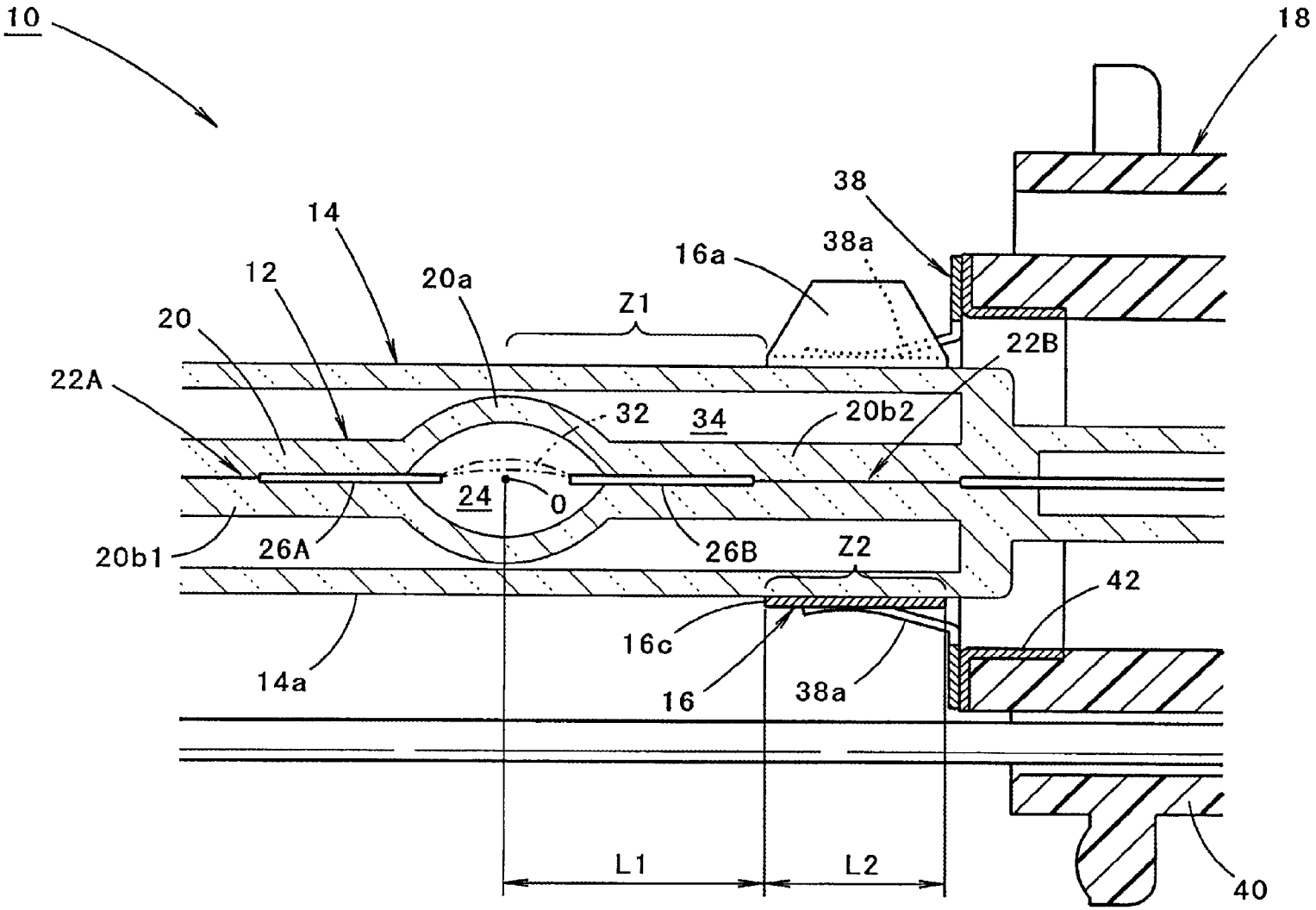
FIG. 2 is an enlarged view of a portion II of FIG. 1.
Figure 3:
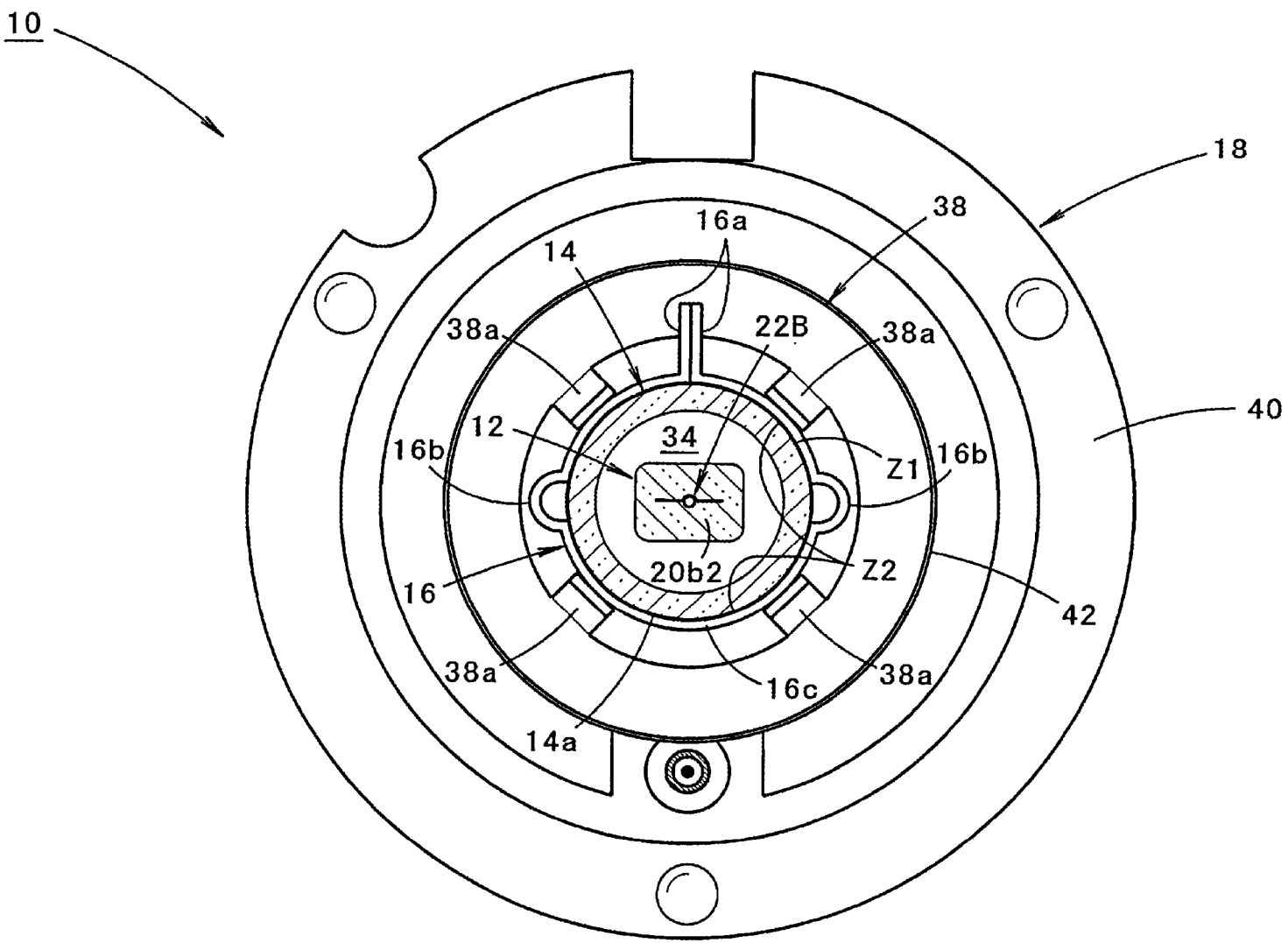
FIG. 3 is a sectional view taken along the line III-III of FIG. 1.

FIGS. 1-3 illustrate a vehicle discharge bulb 10 according to an exemplary embodiment of the present invention. The vehicle discharge bulb 10 is used as a light source of a vehicle lamp such as a headlamp, and the lighting thereof is performed on alternate current.

The vehicle discharge bulb 10 includes an arc tube 12 extending in a front-rear direction, a glass shroud 14 extending in the front-rear direction to cylindrically surround the arc tube 12 and having a front end portion and a rear end portion that are welded to the arc tube 12, a metal band 16 surrounding and holding the rear end portion of the glass shroud 14, and an insulating plug 18 supporting the glass shroud 14 via the metal band 16 in a fixed manner.

The arc tube 12 includes an arc tube body 20 and a pair of front and rear electrode assemblies 22A, 22B embedded in the arc tube body 20. The arc tube body 20 is formed by processing a long and narrow cylindrical quartz glass tube.

In the arc tube body 20 has an ellipsoidal light-emitting tube portion 20*a* in the middle and pinch-sealed portions 20*b*1, 20*b*2 at respective sides of the light-emitting tube portion 20*a* in the front-rear direction. An ellipsoidal discharge space 24 extending in the front-rear direction is formed inside the light-emitting tube portion 20*a*.

Each of the electrode assemblies 22A, 22B includes a rod-shaped tungsten electrode 26A, 26B, a molybdenum lead wire 28A, 28B, and a molybdenum metal foil 30A, 30B coupling the tungsten electrode 26A, 26B and the molybdenum lead wire 28A, 28B. The electrode assemblies 22A, 22B are pinched at the respective pinch-sealed portion 20*b*1, 20*b*2, and are embedded in the arc tube body 20 in a fixed manner.

The metal foils 30A, 30B are entirely embedded in the respective pinch-sealed portions 20*b*1, 20*b*2. Distal end portions of the electrodes 26A, 26B protrude into the discharge space 24 from respective sides in the front-rear direction in an opposed manner. When the discharge bulb 10 is turned on, an arc-shaped discharge light emitting portion 32 is formed between the distal end portions of the electrodes 26A, 26B.

The vehicle discharge bulb 10 according to the exemplary embodiment is configured as a mercury-free discharge bulb.

That is, a rare gas and metal halides are sealed in the discharge space 24, but mercury is not sealed in.

According to this exemplary embodiment, a xenon gas is used as the rare gas. The rare gas is sealed in to facilitate a discharge between the distal end portions of the electrodes 26A, 26B. The metal halides, which are sodium iodide and scandium iodide in this exemplary embodiment, are sealed in to increase the luminous efficacy and to enhance color rendering properties.

Mercury has a buffering function of reducing the damage of the electrodes 26A, 26B by decreasing collisions of electrons with the electrodes 26A, 26B. Being mercury-free, to substitute for the mercury, a metal halide is sealed in to perform the buffering function. For example, one or more of halides of Zn, In, Sb, etc. are used as the buffering metal halide.

A cylindrical space 34 between the arc tube 12 and the glass shroud 14 is filled with a rare gas such as an argon gas or a xenon gas, a simple substance gas such as nitrogen or oxygen, carbon dioxide, or a mixture gas including one or more thereof. The filling pressure of the gas inside the cylindrical space 34 is a negative pressure of about 0.1 atm to 0.9 atm, i.e., about 0.01 MPa to 0.09 MPa.

The metal band 16 is fixed to the outer circumferential surface of the rear end portion of the glass shroud 14.

The metal band 16 is formed to have a cylindrical shape, by bending a strip of metal plate. A pair of flanges 16*a* are formed at respective ends of the metal band 16 in the circumferential direction, and are welded to each other a top of the outer circumferential surface of the glass shroud 14. The metal band 16 is in surface-contact with the outer circumferential surface of the glass shroud 14. Right and left side portions of the metal band 16 protrude from the outer circumferential surface of the glass shroud 14 so as to be separated therefrom to form semi-cylindrical ridges 16*b*.

The metal band 16 is securely supported by a slider metal fitting 38.

The slider metal fitting 38 has engagement protrusions 38*a* at four positions along its circumference. The engagement protrusions 38*a* are engaged with the outer circumferential surface of the metal band 16, and are securely coupled to the metal band 16 by laser welding or the like. The slider metal fitting 38 is securely coupled to the metal band 16 with its rear end surface as a reference surface.

The insulating plug 18 has an insulating plug body 40 and a metal base plate 42 fixed to a front end portion of the insulating plug body 40. The slider metal fitting 38 is connected and fixed to the base plate 42 by laser welding or the like.

The ratio S1/S2 of the surface area S1 of the outer surface 14*a* of the glass shroud 14, in a region Z1 from the circumference of the glass shroud 14 at the position of the center O of the discharge space 24 to a front end edge 16*c* of the metal band 16, to the surface area S2 of a surface Z2 of the metal band 16 that touches the glass shroud 14 (i.e., the inner circumferential surface of the metal band 16 excluding the inner circumferential surfaces of the ridges 16*b*) is 1 to 3 (e.g., about 1.5).

Since the ratio S1/S2 is smaller than or equal to 3, the metal band 16 can be disposed close to the discharge space 24, as a result of which a dielectric barrier discharge is allowed to occur more easily. Furthermore, since the metal band 16 holds the rear end portion of the glass shroud 14 so as to surround it, a dielectric barrier discharge is allowed to occur more easily in a region corresponding to the entire circumference of the cylindrical space 34 between the arc tube 12 and the glass shroud 14.

On the other hand, since the ratio S1/S2 is larger than or equal to 1, when the vehicle discharge bulb 10 according to the exemplary embodiment is incorporated in a vehicle lamp (not shown) the risk that light emitted from the discharge light emitting portion 32 toward a reflector (not shown) is shielded by the metal band 16 can be eliminated or minimized.

Thus, the starting voltage can be lowered though the vehicle discharge bulb 10 according to the exemplary embodiment is a mercury-free bulb.

In the exemplary embodiment, since a dielectric barrier discharge is caused utilizing the metal band 16, peeling of a film can be avoided as in the case where a conductive film is formed on the arc tube 12. This increases the durability of the vehicle discharge bulb 10.

In addition, since a dielectric barrier discharge is caused utilizing the metal band 16, the necessity to reduce the pressure of the gas sealed in the cylindrical space 24 between the arc tube 12 and the glass shroud 14, to cause a dielectric barrier discharge can be lowered.

It is advantageous to set the distance L1 from the circumference of the glass shroud 14 at the position of the center O of the discharge space 24 to the front end edge 16*c* of the metal band 16 to be 3 mm to 15 mm (e.g., about 8 mm).

That is, if the distance L1 is shorter than 3 mm, in a state in which the vehicle discharge bulb 10 is installed in a vehicle lamp, light directed toward a reflector from the discharge light emitting portion 32 becomes likely to be blocked by the metal band 16 so that a light beam from the light source may not be used effectively to form a light distribution pattern. On the other hand, if the distance L1 is longer than 15 mm, the metal band 16 becomes too distant from the discharge space 24 that it is difficult to generate a dielectric barrier discharge.

It is also advantageous to set the width L2 of the metal band 16 in the front-rear direction to be 3 mm to 15 mm (e.g., about 5 mm)

If the width L2 is shorter than 3 mm, the area where the glass shroud 14 is held by the metal band 16 becomes so small that it is difficult for the insulating plug 18 to securely support the glass shroud 14 via the metal band 16 in a stable manner.

On the other hand, if the width L2 is greater than 15 mm, a bending work for forming the metal band 16 is not easy. Further, because a portion of the glass shroud 14 to be held by the metal band 16 becomes longer, play may occur due to uneven contact between the metal band 16 and the glass shroud 14.

While the present invention has been described with reference to a certain exemplary embodiment thereof, the scope of the present invention is not limited to the exemplary embodiment described above, and it will be understood by those skilled in the art that various changes and modifications may be made therein without departing from the scope of the present invention as defined by the appended claims.

What is claimed is:

1. A mercury-free vehicle discharge bulb comprising:

an arc tube comprising a light-emitting tube portion, pinch sealed portions between which the light-emitting tube portion is disposed, and a pair of electrodes provided in the pinch-sealed portions such that distal end portions of the pair of electrodes protrude into a discharge space of the light-emitting tube portion in an opposed manner;

a glass shroud extending in a front-rear direction to cylindrically surround the arc tube, the glass shroud comprising a front end portion and a rear end portion that are welded to the arc tube;

a metal band surrounding and holding the rear end portion of the glass shroud; and an insulating plug supporting the glass shroud in a fixed manner via the metal band, wherein a ratio S1/S2 of a first area S1 to a second area S2 is 1 to 3, wherein the first area S1 is a surface area of an outer surface of the glass shroud in a region from a circumference of the glass shroud at a position of a center of the discharge space to a front end edge of the metal band, and wherein the second area S2 is a surface area of a surface of the metal band that touches the glass shroud.

2. The vehicle discharge bulb according to claim 1, wherein a distance along the outer surface of the glass shroud from the circumference of the glass shroud at the position of the center of the discharge space to the front end edge of the metal band is 3 mm to 15 mm.

3. The vehicle discharge bulb according to claim 1, wherein a width of the metal band in the front-rear direction is 3 mm to 15 mm.

4. The vehicle discharge bulb according to claim 1, wherein the metal band comprises flanges that are welded together at a top of the glass shroud.

5. The vehicle discharge bulb according to claim 1, wherein the metal band comprises semi-cylindrical ridges on lateral sides of the metal band, wherein an inner surface of the semi-cylindrical ridges does not touch the glass shroud.

* * * * *